US008632377B2

(12) United States Patent
Tanaka

(10) Patent No.: US 8,632,377 B2
(45) Date of Patent: Jan. 21, 2014

(54) ULTRASONIC TRIMMING METHOD

(71) Applicant: Norio Tanaka, Isesaki (JP)

(72) Inventor: Norio Tanaka, Isesaki (JP)

(73) Assignee: Nihon Shoryoku Kikai Co., Ltd., Gunma (JP)

( * ) Notice: Subject to any disclaimer, the term of this patent is extended or adjusted under 35 U.S.C. 154(b) by 0 days.

(21) Appl. No.: 13/906,141

(22) Filed: May 30, 2013

(65) Prior Publication Data

US 2013/0247727 A1 Sep. 26, 2013

Related U.S. Application Data

(62) Division of application No. 13/481,522, filed on May 25, 2012, now Pat. No. 8,512,094, which is a division of application No. 11/644,554, filed as application No. PCT/JP2006/314797 on Jul. 26, 2006, now Pat. No. 8,277,282.

(30) Foreign Application Priority Data

Oct. 4, 2005 (JP) ..... 2005-291617

(51) Int. Cl.
*B24B 51/00* (2006.01)

(52) U.S. Cl.
USPC ..... 451/11; 451/45; 451/165

(58) Field of Classification Search
USPC ..... 451/5, 8, 11, 45, 56, 72, 165
See application file for complete search history.

(56) References Cited

U.S. PATENT DOCUMENTS

| | | | | |
|---|---|---|---|---|
| 3,233,371 | A | 2/1966 | Stucker | |
| 4,596,171 | A * | 6/1986 | Gerber | 83/56 |
| 4,732,064 | A | 3/1988 | Pearl | |
| 4,762,040 | A | 8/1988 | Alcantara Perez et al. | |
| 5,168,787 | A | 12/1992 | Blaimschein | |
| 5,318,420 | A | 6/1994 | Blaimschein | |
| 5,931,071 | A * | 8/1999 | Mori | 83/74 |
| 6,131,498 | A | 10/2000 | Gerber | |
| 6,360,639 | B1 | 3/2002 | Gerber | |
| 6,663,465 | B2 * | 12/2003 | Gross | 451/5 |
| 7,614,937 | B2 | 11/2009 | Nydegger | |
| 8,277,282 | B2 * | 10/2012 | Tanaka | 451/11 |
| 8,512,094 | B2 * | 8/2013 | Tanaka | 451/5 |

(Continued)

FOREIGN PATENT DOCUMENTS

| | | |
|---|---|---|
| DE | 298 13 964 U | 12/1998 |
| DE | 100 21 302 A | 11/2001 |

(Continued)

*Primary Examiner* — Maurina Rachuba
(74) *Attorney, Agent, or Firm* — DLA Piper LLP (US)

(57) ABSTRACT

An ultrasonic trimming method is composed of steps, driving a cutter blade having a flat plate shape and supported by an arm at an end of an articulated robot via an ultrasonic oscillator, the cutter blade being driven by the arm while the cutter blade is ultrasonically vibrated; cutting a workpiece secured by a workpiece securing portion; and during, operation for cutting, moving the cutter blade held attached to the articulated robot to the position at where the cutting edge is brought into contact with the grindstone, maintaining the cutter blades attitude such that a plane containing the cutting edge thereof contacts the grindstone, and grinding the cutter blade by pressing the cutter blade against a grinding member by the arm while the cutter blade is ultrasonically vibrated, the grinding member being disposed within a movable range of the cutter blade driven by the articulated robot.

3 Claims, 13 Drawing Sheets

(56) References Cited

U.S. PATENT DOCUMENTS

| | | | | |
|---|---|---|---|---|
| 2001/0049987 | A1* | 12/2001 | Vivirito et al. | 83/174 |
| 2003/0021861 | A1* | 1/2003 | Yamada | 425/308 |
| 2009/0127145 | A1* | 5/2009 | Nonaka et al. | 206/349 |

FOREIGN PATENT DOCUMENTS

| | | | |
|---|---|---|---|
| EP | 0 465 754 | A | 1/1992 |
| GB | 2 042 948 | A | 10/1980 |
| JP | 61-095812 | A | 5/1986 |
| JP | 63-109997 | A | 5/1988 |
| JP | 63-156691 | A | 6/1988 |
| JP | S63-191597 | A | 8/1988 |
| JP | 1-143393 | A | 10/1989 |
| JP | 4-51396 | A | 4/1992 |
| JP | 04-336996 | A | 11/1992 |
| JP | 5-53896 | A | 7/1993 |
| JP | H6-39690 | A | 2/1994 |
| JP | H07-335592 | A | 12/1995 |
| JP | 09-201794 | A | 8/1997 |
| JP | H10-167774 | A | 6/1998 |
| JP | 10-180682 | A | 7/1998 |
| JP | 2000-354989 | A | 12/2000 |
| JP | 2003-351355 | A | 12/2000 |
| JP | 04-336996 | A | 1/2001 |
| JP | 2001-038598 | A | 2/2001 |
| JP | 2003-1639 | A | 1/2003 |
| JP | 2004-009255 | A | 1/2004 |
| JP | 2004-148446 | A | 5/2004 |
| JP | 2005-032178 | A | 2/2005 |
| JP | 2008-273212 | A | 11/2008 |
| RU | 1805037 | | 3/1993 |
| RU | 2019362 | | 9/1994 |

* cited by examiner

ULTRASONIC TRIMMING METHOD

This is a Divisional Application, under 37 CFR §1.53(b), of the application Ser. No. 13/481,522 of May 25, 2012, which is a Divisional Application, under 37 CFR §1.53(b), of the application Ser. No. 11/664,554 of Apr. 3, 2007 (filed based on PCT/JP2006/314797 of Jul. 26, 2006), which is hereby incorporated in its entirety by reference.

TECHNICAL FIELD

The present invention relates to an ultrasonic trimming method for efficiently cutting a workpiece such as a sheet material composed of soft material such as plastic, fabric, or rubber, a composite material, or a material containing glass fiber even when the workpiece has a three-dimensional shape.

BACKGROUND ART

When a sheet of the abovementioned soft material is cut, an edge tool, an ultrasonic cutter, a water jet, or the like has been used conventionally. The use of an edge tool or an ultrasonic cutter has advantages in that the amount of dust generated is small and in that process steps associated therewith, such as waste water treatment, are not required. However, the direction of the edge must be aligned along the moving direction. Furthermore, when a workpiece has a three-dimensional curved surface, more complicated data must be input to a control device for moving the edge tool or the ultrasonic cutter. In addition to this, there is a limit on the control for meeting various requirements on the thickness of a workpiece, the properties of a cut surface, and the like.

Meanwhile, when a water jet is used, work data input to a control device is simplified, but various problems exist. For example, waste water treatment is required, and a workpiece becomes wet. Furthermore, water splashes around the workpiece to deteriorate the working environment, and noise is large. Also, when workpieces are overlapped, it is difficult to cut only one of the workpieces. In addition, the initial cost and running cost are high.

Therefore, in order to solve the abovementioned problems, it has been conceived to mount an ultrasonic cutter on an articulated robot. With such a configuration, the running cost is expected to be reduced, and the restriction on cutting positions is expected to be relaxed. In addition, flexibility in cutting quality can be achieved, and consideration can be given to the environment in terms of drainage, dust, vibration, and noise.

However, in an ultrasonic trimming apparatus having an ultrasonic cutter mounted on an articulated robot, when a cutter blade becomes blunt, the operation must be frequently interrupted to replace the cutter blade. Therefore, a problem exists in that trimming cannot be efficiently performed unless a cutter blade is efficiently replaced.

Furthermore, it may not be publicly known that a cutter blade can be ground by bringing a grinding apparatus having a rotary grindstone close to the cutter blade held attached to a robot. However, when the grinding apparatus is brought close to the cuter blade and the grindstone is rotated, the configuration becomes complicated, and thus it cannot be expected to perform rapid grinding.

Moreover, when a workpiece formed of a soft material is cut, and particularly when the workpiece has a large area, a large number of mechanical clamps are required to secure the workpiece with the clamps, thereby reducing the efficiency. Furthermore, when the outer periphery of the workpiece is trimmed, the clamps are present within the moving range of the cutter blade. Therefore, interference between the cutter blade and the clamps occurs, thereby causing a problem that the working is not completed.

Meanwhile, when a workpiece is formed into a three-dimensional shape, it is important to cut the workpiece with the three-dimensional shape thereof being maintained. Therefore, a configuration has been employed in which a workpiece is cut while being held by a vertical pair of mold jigs which have been worked into the same shape as that of the workpiece. However, in this configuration, two molds, or upper and lower molds, are required, thereby causing a problem of cost increase.

Furthermore, since a six-axis articulated robot has six degrees of freedom, both the position and attitude of a cutter blade can be controlled freely in a three-dimensional space. However, in the structure of the robot, there exists a singular point where the degrees of freedom of motion are reduced to restrict the motion thereof. There are several types of robots including a robot which stops at the singular point, a robot which does not stop at the singular point but passes through the singular point while being operated unstably, and a robot which does not pass through the singular point but is controlled to pass near the singular point. However, in each of these robots, teaching is required to keep away from the singular point, and thus the reduction of the operation speed of the robot and the complication of the teaching are inevitable. Furthermore, in a robot having minimum degrees of freedom, the axes thereof are often fully utilized even in normal teaching, and thus a large amount of time is required for teaching.

DISCLOSURE OF THE INVENTION

Accordingly, it is a first object of the present invention to provide an ultrasonic trimming method which is capable of efficiently performing trimming by efficiently grinding a cutter blade.

It is another object of the invention to provide an ultrasonic trimming method which is capable of efficiently performing desired trimming by stably holding a workpiece molded into a three-dimensional shape.

It is yet another object of the invention to provide an ultrasonic trimming method in which the degrees of freedom is increased to eliminate any singular point, whereby teaching to a robot can be efficiently performed and good operation speed can be obtained.

In summary, the above-described objectives are achieved by the following embodiments of the present invention.

An ultrasonic method, comprising: driving a cutter blade having a flat plate shape and supported by an arm at an end of an articulated robot via an ultrasonic oscillator, the cutter blade being driven by the arm while the cutter blade is ultrasonically vibrated; cutting a workpiece secured by a workpiece securing portion; and during, operation for cutting, moving the cutter blade held attached to the articulated robot to the position at where the cutting edge is brought into contact with the grindstone, maintaining the cutter blades attitude such that a plane containing the cutting edge thereof contacts the grindstone, and grinding the cutter blade by pressing the cutter blade against a grinding member by the arm while the cutter blade is ultrasonically vibrated, the grinding member being disposed within a movable range of the cutter blade driven by the articulated robot.

By employing such a configuration, the cutter blade can be efficiently ground by moving the cutter blade by means of the articulated robot such that the cutter blade is brought into contact with the grinding member and by vibrating the cutter blade by driving the ultrasonic oscillator. In the present application, the grinding includes, in addition to ordinary grinding, the case of removing adhering materials such as resin and glass powder having adhered to the cutting edge of the cutter blade during the trimming of a workpiece.

BEST MODE FOR CARRYING OUT THE INVENTION

Figure 1:
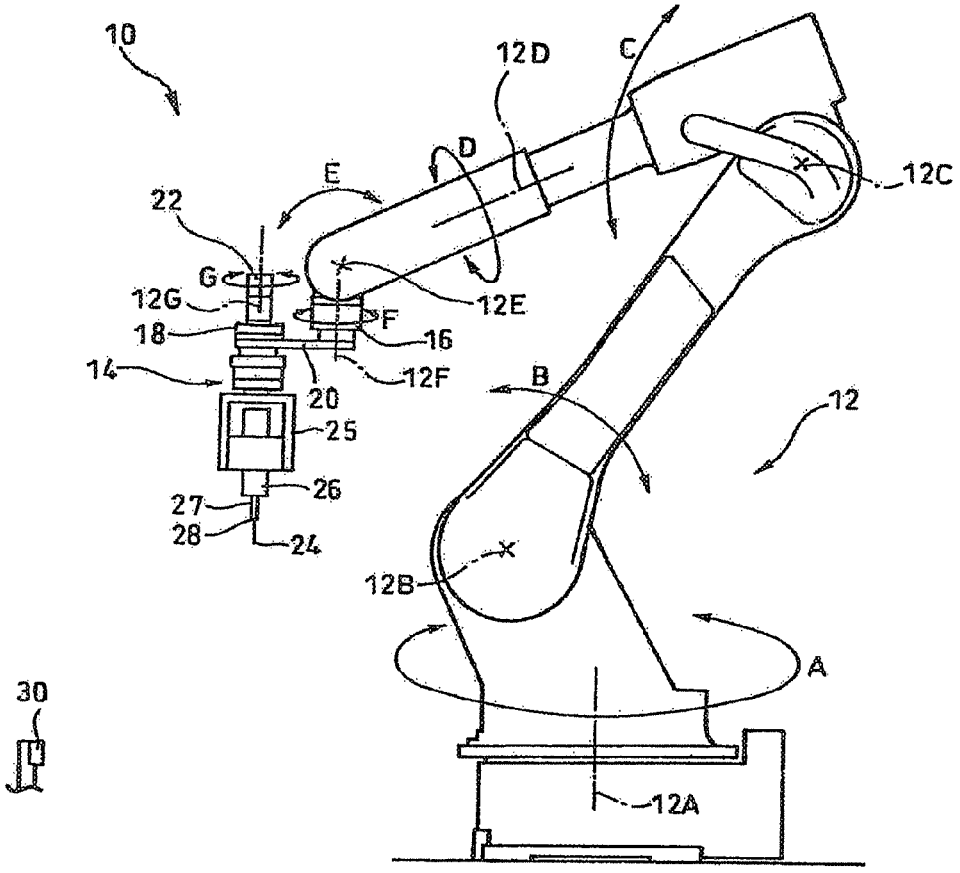
FIG. 1 is a front view of a robot, illustrating an embodiment of an ultrasonic trimming apparatus according to the present invention.

As shown in FIG. 1, an ultrasonic trimming apparatus 10 of the present invention is composed of an articulated robot 12 (hereinafter referred to as a robot 12), a cutting apparatus 14, and a grindstone 30.

The robot 12 of this embodiment includes a general six-axis vertical articulated robot which has six degrees of freedom provided by six joints indicated by arrows A, B, C, D, E, and F. To an arm 16 at the end of the robot 12 is connected an additional arm 18 having an axis line parallel to the axis line (a sixth axis 12F) of the arm 16 through a connection arm 20. Since the abovementioned six-axis vertical articulated robot is of a general type, the detailed description thereof is omitted. In FIG. 1, symbols 12A, 12B, 12C, 12D, 12E, and 12F represent first to sixth joints, respectively, of the six-axis vertical articulated robot.

The additional arm 18 can be rotationally moved around a seventh axis 12G, as shown by an arrow G, by means of a motor 22 connected to the additional arm 18. Since the additional arm 18 can be rotationally moved, the degrees of freedom of the robot 12 are increased to seven, and thus a cutter blade 24 described later can always maintain its attitude so as to be aligned along a cutting direction.

The abovementioned cutting apparatus 14 is supported on the end side of the additional arm 18. The cutting apparatus 14 is composed of a supporting block 25 attached to the end of the additional arm 18, an ultrasonic oscillator 26 attached to the supporting block 25, a vibrator 27 and a supporting horn 28 attached to the ultrasonic oscillator 26, and the abovementioned cutter blade 24 supported by the supporting horn 28.

The ultrasonic oscillator 26 is disposed so as to vibrate in the direction of the rotation axis of the additional arm 18, i.e., the direction of the seventh axis 12G. Therefore, the cutter blade 24 vibrates in the direction of the seventh axis 12G.

The abovementioned cutter blade 24 is formed into a flat plate shape by use of a super hard material having elasticity. In the articulated robot 12 having the abovementioned additional arm 18 added thereto and thus having seven degrees of freedom, the additional arm 18 can be rotated by means of the motor 22 to control the attitude thereof. Therefore, the attitude of the cutter blade 24 having the flat plate shape can be maintained such that the cutting edge of the cutter blade 24 crosses a predetermined cutting line CL and that a flat plate (a flat plane) containing the cutting edge serves as a contact surface, whereby the cutter blade 24 can be moved along the predetermined cutting line CL with the cutting edge always directed in a cutting direction.

Figure 2:
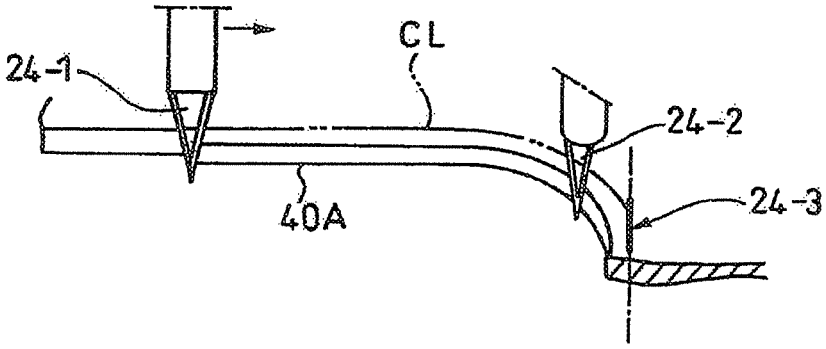
FIG. 2 is a perspective view schematically illustrating the relation between the attitude of a cutter blade and a predetermined cutting line in the ultrasonic trimming apparatus.
Figure 3:
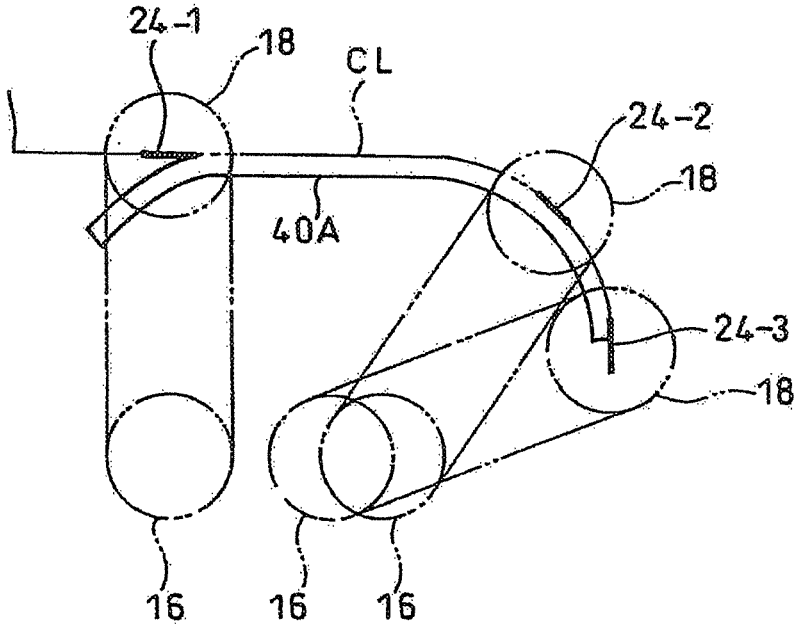
FIG. 3 is a plan view schematically illustrating the relation between the attitude of the cutter blade and the predetermined cutting line in the ultrasonic trimming apparatus.
Figure 4:
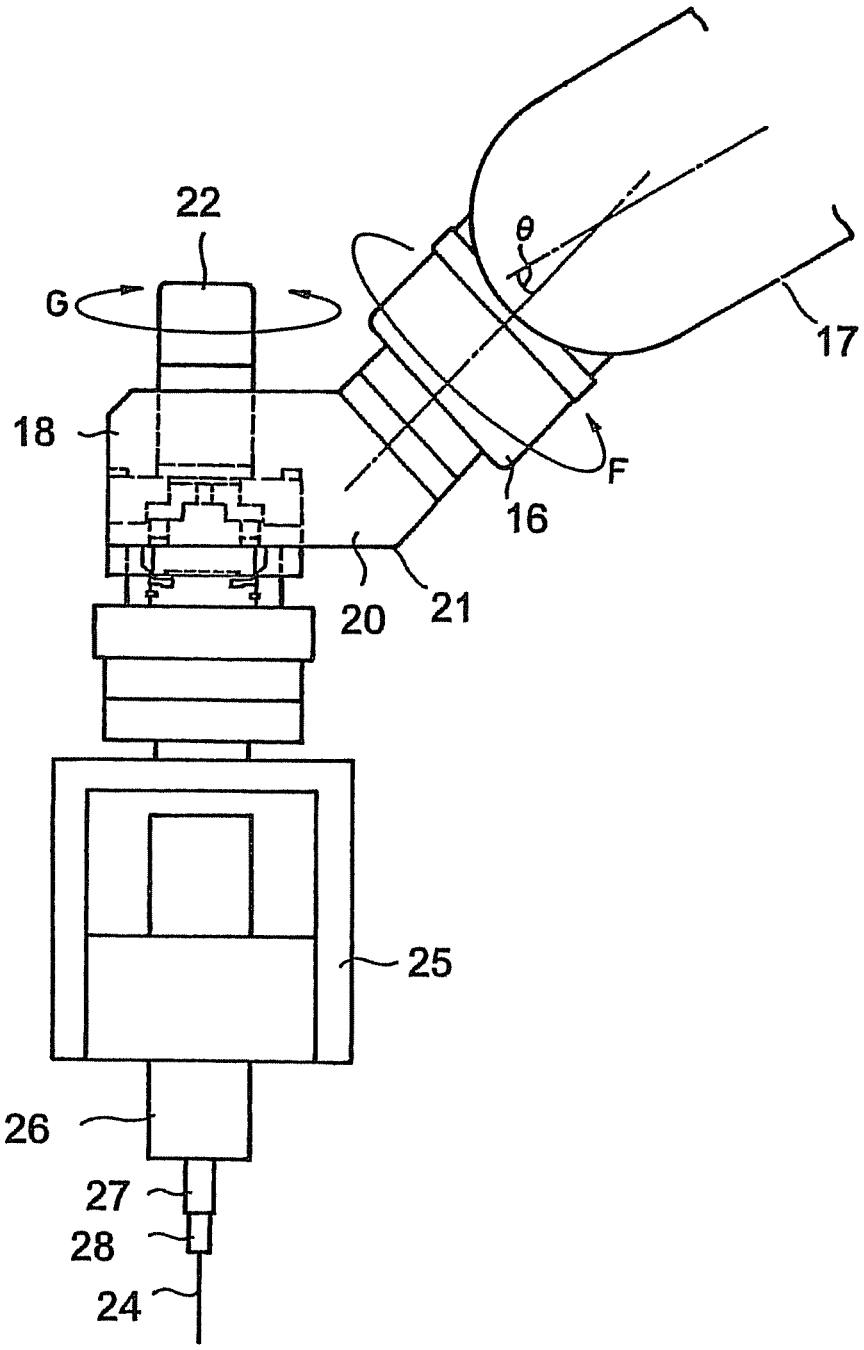
FIG. 4 is a front view illustrating a connection structure of an end arm different from that in FIG. 1.

Symbols 24-1, 24-2, and 24-3 in FIGS. 2 and 3 represent the attitudes of the cutter blade 24 at different positions on the predetermined cutting line CL. At each of the positions, the cutting edge of the cutter blade 24 is directed in the moving direction, and the flat plane containing the cutting edge (indicated by an alternate long and short dashed line in FIG. 2) serves as the contact surface with the predetermined cutting line CL. A symbol 40A in FIGS. 2 and 3 represents an opening to be trimmed. The cutter blade 24 is a double-edged blade but may be a single-edged blade.

The predetermined cutting line is determined based on data input in advance to a control apparatus (not shown) of the robot 12 through teaching or a program. The robot 12 moves the cutter blade 24 along the predetermined cutting line.

Furthermore, the attitude of the cutter blade 24 at the time of cutting, the timing of grinding described later, the motion of the cutter blade 24 toward the grinding member, and the attitude of the cutter blade 24 at the time of grinding are all determined based on data input in advance through teaching or a program.

In FIG. 1, the axis line of the arm 16 and the axis line of the additional arm 18 are parallel to each other. However, as shown in FIG. 2, by providing a bent portion 21 in the connection arm 20, the arm 16 and the additional arm 18 may be disposed such that the axis lines thereof cross each other. In the configuration of FIG. 2, when a crossing angle θ between the arm 16 and an arm 17 which is located closer to a base portion than is the arm 16 is less than 15 degrees, a singular point is formed. Thus, the crossing angle θ must be set to 15 degrees or larger.

Figure 5:
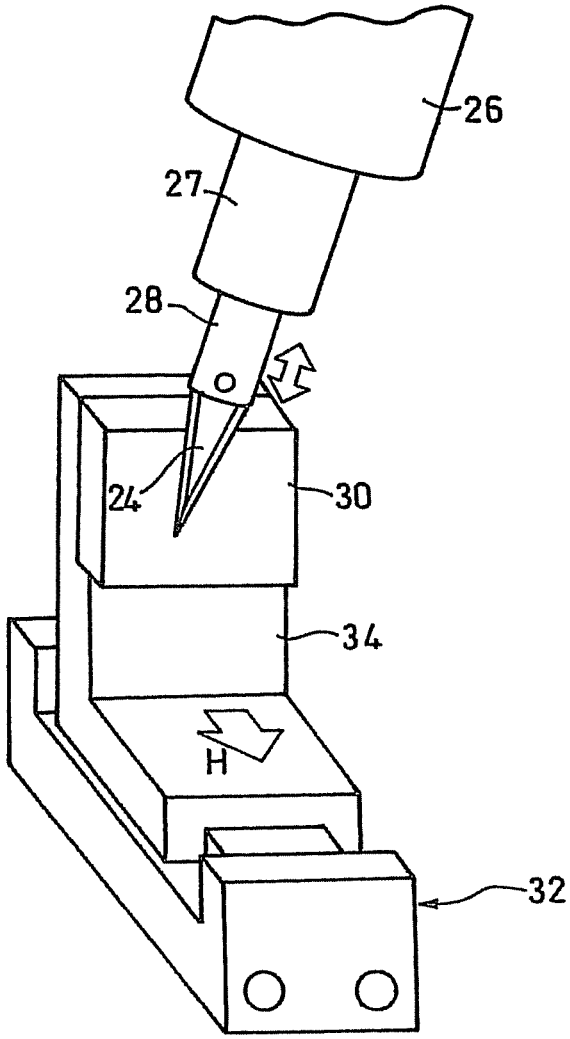
FIG. 5 is a front view illustrating the configuration around a grindstone in the embodiment of FIG. 1.

FIG. 5 shows the configuration around the abovementioned grindstone 30 serving as a grinding member for grinding the abovementioned cutter blade 24. The grindstone 30 is positioned within the moving range of the cutter blade 24 driven by the robot 12. The abovementioned grindstone 30 is secured to a movable block 34 movably supported by a pneumatic cylinder 32 which is an example of a fluid pressure cylinder. The grindstone 30 is driven by the abovementioned pneumatic cylinder 32 and is urged in a direction in which the grindstone 30 is brought into pressure contact with the cutter blade 24 as shown by an arrow H in FIG. 5.

Therefore, in the state in which the grindstone 30 is brought into pressure contact with the cutter blade 24, the cutter blade 24 vibrates with the ultrasonic oscillator 26 being driven, whereby the cutter blade 24 can be ground with the grindstone 30. Here, a diamond grindstone containing diamond abrasive particles is employed as the grindstone 30.

The cutter blade 24 is positioned according to the abovementioned teaching or program such that a plane containing the cutting edge thereof is parallel to the grindstone 30. Here, since the abovementioned pneumatic cylinder 32 is of a general type, the detailed description thereof is omitted.

Figure 6:
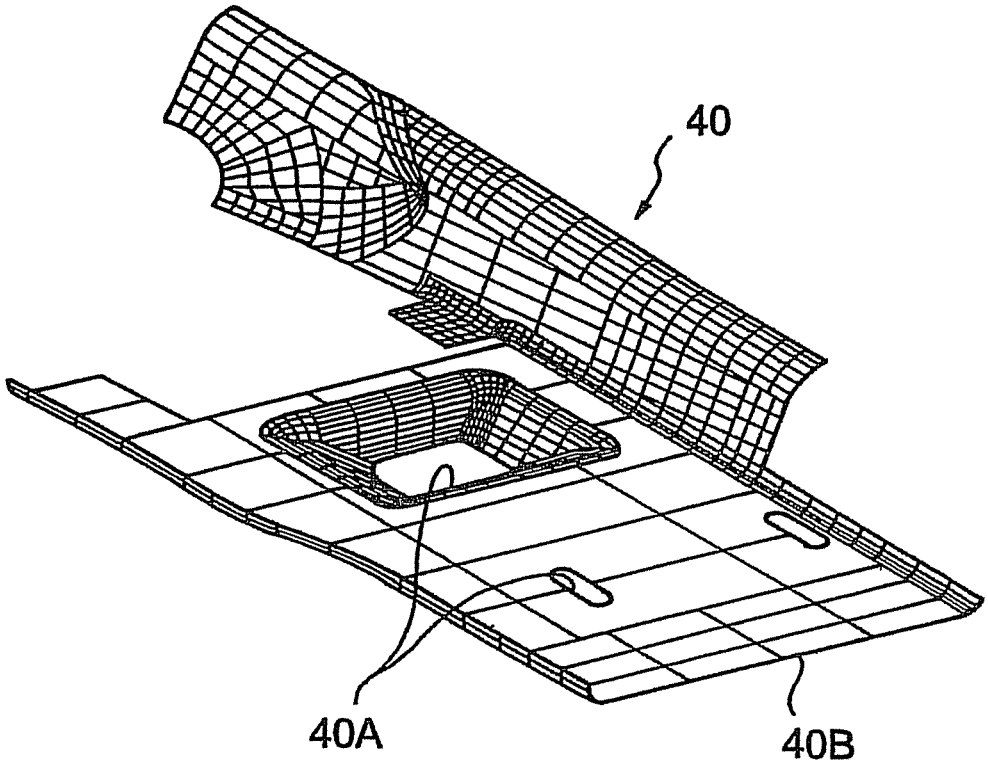
FIG. 6 is a perspective view of a workpiece to be trimmed by means of the ultrasonic trimming apparatus of FIG. 1.

FIG. 6 illustrates a workpiece 40 which has a three-dimensional shape and is to be trimmed by means of the ultrasonic trimming apparatus 10 of this embodiment. This workpiece 40 is formed of a sheet material composed of a soft material such as plastic, fabric, or rubber, a composite material, or a material containing glass fiber. An opening 40A and an outer periphery 40B of the workpiece 40 are trimmed by means of the ultrasonic trimming apparatus 10 of this embodiment.

Figure 7:
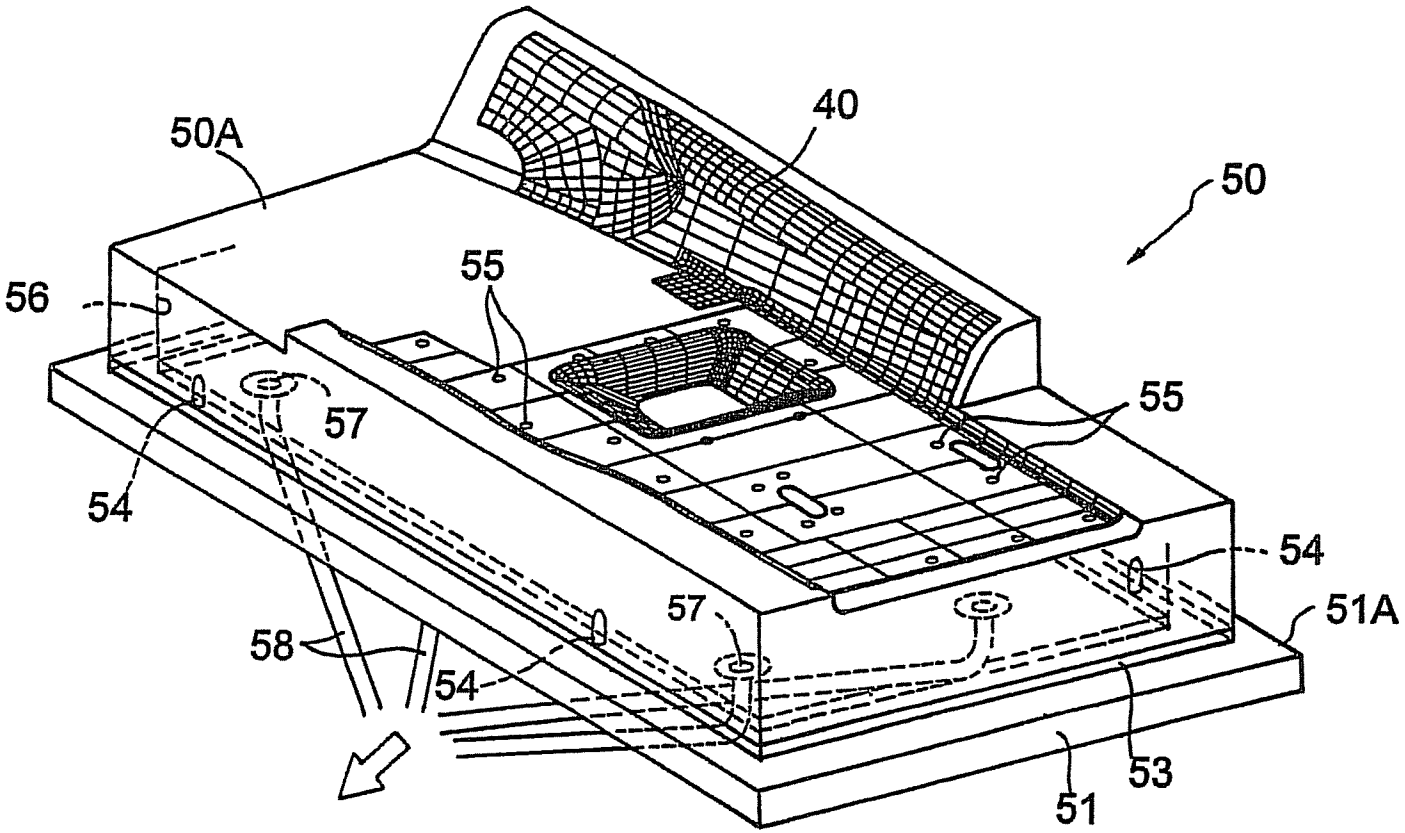
FIG. 7 is a perspective view illustrating an embodiment of a mold jig for holding the workpiece of FIG. 6 by suction.

FIG. 7 illustrates one mold jig 50 for fixing the workpiece 40.

The mold jig 50 is secured to a substrate 51 through a packing 53 for preventing air leakage. Furthermore, the mold jig 50 is secured at a normal position on the substrate 51 through a plurality of positioning pins 54 projecting above the substrate 51.

The mold jig 50 has an upper surface 50A formed into a shape conforming to the shape of a three-dimensional female mold for the abovementioned workpiece 40 in its product state. Furthermore, a large number of small-diameter suction holes 55 are formed in the upper surface 50A. An inner sealed space 56 in communication with each of the suction holes 55 is formed inside the mold jig 50. Meanwhile, a plurality of suction ports 57 in communication with the inner sealed space 56 of the mold jig 50 are provided on an upper surface 51A of the substrate 51. Suction means (not shown), such as a fan, a blower, or a pump, for generating negative pressure inside the inner sealed space 56 is connected to each of the suction ports 57 through a pipe 58.

Therefore, by driving the suction means after the workpiece 40 is placed on the upper surface 50A of the mold jig 50, negative pressure is generated inside the inner sealed space 56 and each of the suction holes 55, whereby the workpiece 40 is held by suction on the upper surface 50A of the mold jig 50.

Meanwhile, a plurality of mold jigs 50 can be disposed on the substrate 51 such that the mold jigs 50 are opposed to the respective suction ports 57 on the upper surface 51A of the substrate 51.

Figure 8:
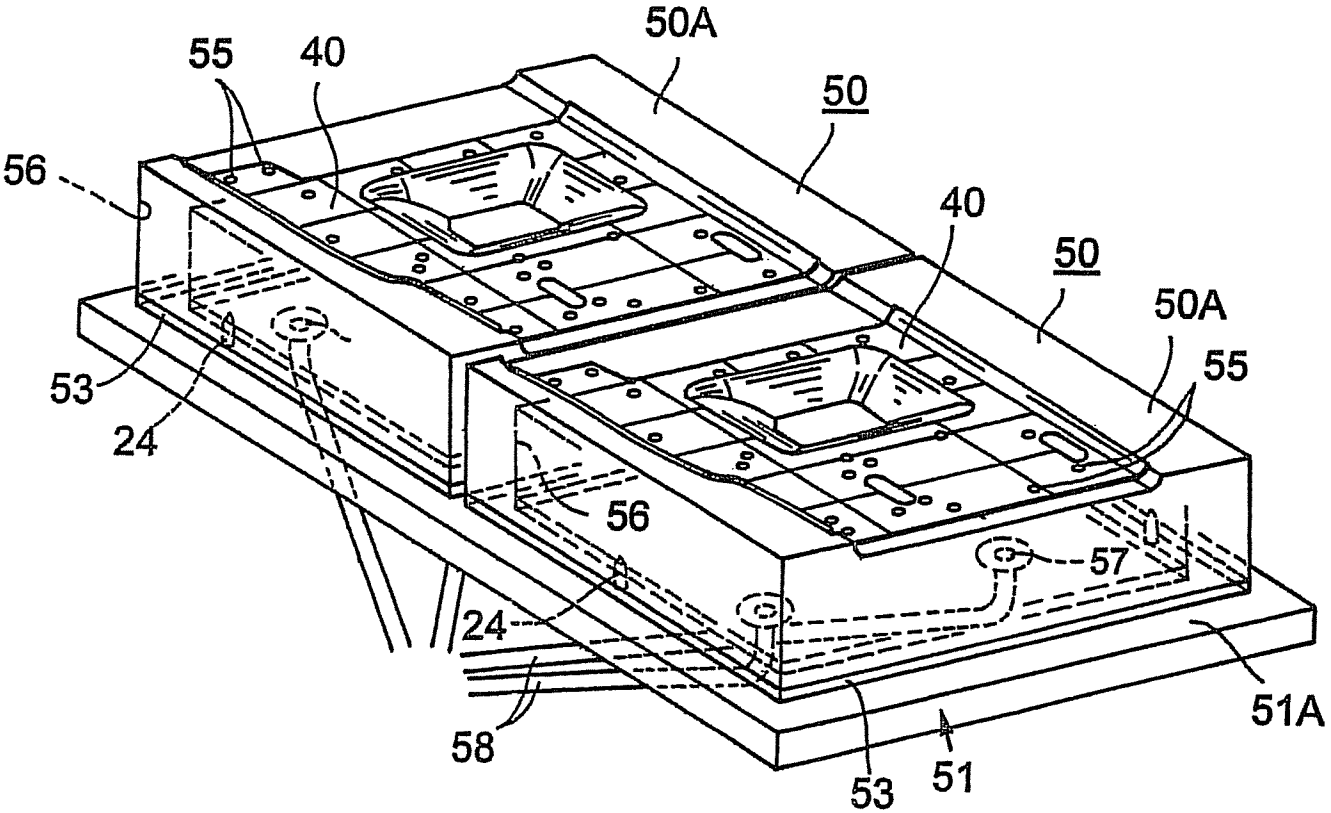
FIG. 8 is a perspective view illustrating an embodiment in which two mold jigs are disposed on a substrate.

FIG. 8 illustrates the state in which two mold jigs 50 are disposed on the upper surface 51A of the substrate 51 so as to be separated from each other by a distance.

As described above, a plurality of mold jigs 50 can be disposed on the substrate 51. Therefore, mold jigs 50, which each have a size corresponding to the shape of a workpiece and of which number is the same as that of the workpieces, can be disposed. Furthermore, since the lower portion of each of the mold jigs 50 is the empty inner sealed space 56, the structure is advantageous to change the shape and for maintenance.

Figure 9:
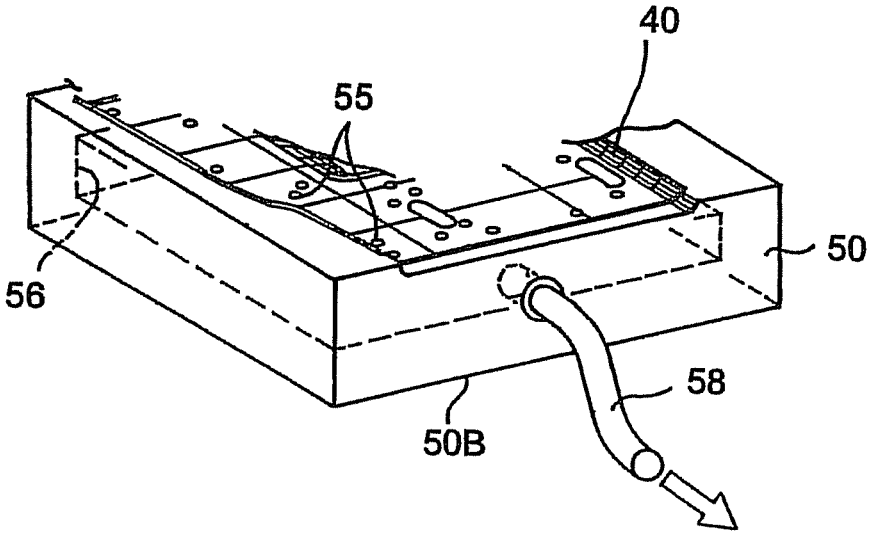
FIG. 9 is a perspective view illustrating another embodiment of the mold jig.

Moreover, a lower surface 50B of a mold jig 50 shown in FIG. 9 may be sealed, and the pipe 58 may be connected through a side portion to the abovementioned inner sealed space 56 for connection to the suction means (not shown).

Figure 10:
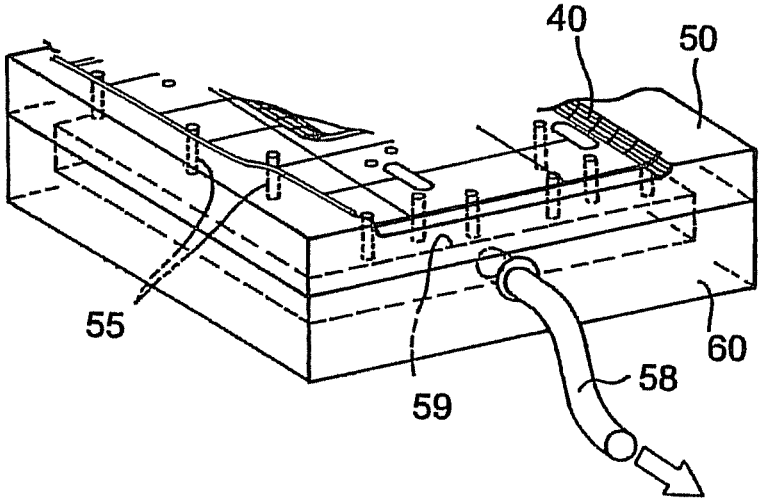
FIG. 10 is a perspective view illustrating yet another embodiment of the mold jig.

In addition, as shown in FIG. 10, a substrate 60 having an inner sealed space 59 may be provided below the mold jig 50. In this case, each of the suction holes 55 of the mold jig 50 is in communication with the inner sealed space 59, and the pipe 58 may be connected through a side portion to the inner sealed space 59 for connection to the suction means (not shown).

Next, a description is given of the action of the ultrasonic trimming apparatus 10 according to this embodiment and having the abovementioned configuration.

The suction means is driven after the workpiece 40 is placed on the upper surface 50A of the mold jig 50, and thereby the workpiece 40 is held by suction on the upper surface 50A of the mold jig 50.

In the above state, the robot 12 is driven and the ultrasonic oscillator 26 is driven, and then the cutter blade 24 is moved while being ultrasonically vibrated. The cutter blade 24 having a flat plate shape maintains its attitude which provides a contact surface along a predetermined cutting line, and the cutting edge of the cutter blade 24 is always directed in the moving direction. Furthermore, the cutter blade 24 is ultrasonically vibrated in a direction orthogonal to the predetermined cutting line. Therefore, the workpiece 40 can be cut easily. In addition, the opening 40A and the outer periphery 40B of the workpiece having a three-dimensional shape can be stably trimmed without experiencing any interference from clamps and the like.

The grindstone 30 is disposed within the movable range of the cutter blade 24 driven by the robot 12. Therefore, when the cutting edge of the cutter blade 24 becomes blunt, the cutter blade 24 held attached to the robot 12 is moved to the position of the grindstone 30, and the cutting edge is brought into contact with the grindstone 30 as shown in FIG. 5. At this time, according to the abovementioned teaching or program, the cutter blade 24 maintains its attitude such that a plane containing the cutting edge thereof contacts the grindstone 30, as described above.

Next, by driving the pneumatic cylinder 32, the grindstone 30 is brought into pressure contact with the cutter blade 24. In this state, by driving the ultrasonic oscillator 26, the cutter blade 24 is ultrasonically vibrated, whereby the cutter blade 24 can be ground with the grindstone 30.

In this manner, the cutter blade 24 can be ground rapidly without removing the cutter blade 24 from the robot 12 and attaching the ground cutter blade 24 to the robot 12. Thus, the interruption time of the operation can be reduced, whereby trimming can be performed efficiently. Furthermore, the cutter blade 24 can be ground at lower cost and in shorter time as compared to the case in which an ordinary grinding apparatus is brought close to the cutter blade 24 to grind the cutter blade 24 with a rotary grindstone.

Furthermore, in the ultrasonic trimming apparatus 10 of this embodiment, a workpiece fixing member has the mold jig 50 which is for placing the workpiece and is formed into a shape (a female mold shape) corresponding to the shape of the workpiece 40. In the mold jig 50 a plurality of the suction holes 55 for sucking the workpiece are formed, and each of the suction holes 55 is in communication with the air suction means. Thus, after the workpiece 40 is placed on the mold jig 50, the workpiece 40 can be held by generating negative pressure in each of the suction holes 55. Hence, even the workpiece 40 having a three-dimensional shape can be stably held by one mold jig 50 to trim the entire portion of the workpiece 40.

Moreover, the inner sealed space 56 in communication with each of the suction holes 55 is formed in the mold jig 50, and the air suction means is in communication with the inner sealed space 56. Therefore, by drawing air from the inner sealed space 56 to generate negative pressure inside each of the suction holes 55, the workpiece 40 having a three-dimensional shape can be held stably.

Furthermore, the additional arm 18 which supports the abovementioned ultrasonic oscillator 26 and the cutter blade 24 and which controls the cutter blade 24 such that the cutter blade 24 is always directed in the cutting direction is rotatably connected to the end arm of the articulated robot 12. Therefore, the degrees of freedom of the robot 12 can be increased to eliminate a singular point. Thus, teaching for keeping away from a singular point is not required, and the operation speed of the robot 12 is not reduced. In addition, teaching can be simplified to reduce the time required for the teaching.

In the above embodiment, the grindstone 30 is stationary, and the cutter blade 24 is pressed against the grindstone 30 while being ultrasonically vibrated. However, the grindstone 30 may be configured to rotate or vibrate.

Figure 11:
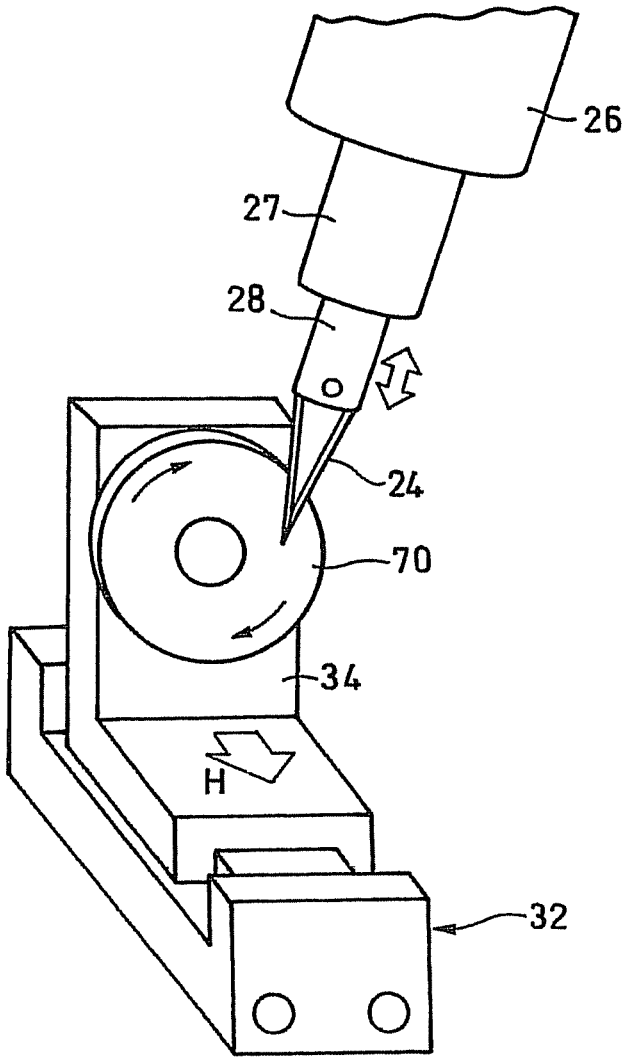
FIG. 11 is a perspective view schematically illustrating another embodiment of a grinding member.

For example, a rotary grindstone 70 may be employed as the grindstone as shown in FIG. 11.

In this case, preferably, the combined vibration direction of the combination of the rotation direction of the rotary grindstone 70 and the direction of the ultrasonic vibration of the cutter blade 24 is orthogonal to the cutting edge of the cutter blade 24. That is, preferably, grinding is performed in a direction orthogonal to the cutting edge of the cutter blade 24. In this manner, the cutting performance of the cutter blade 24 is improved.

Figure 12:
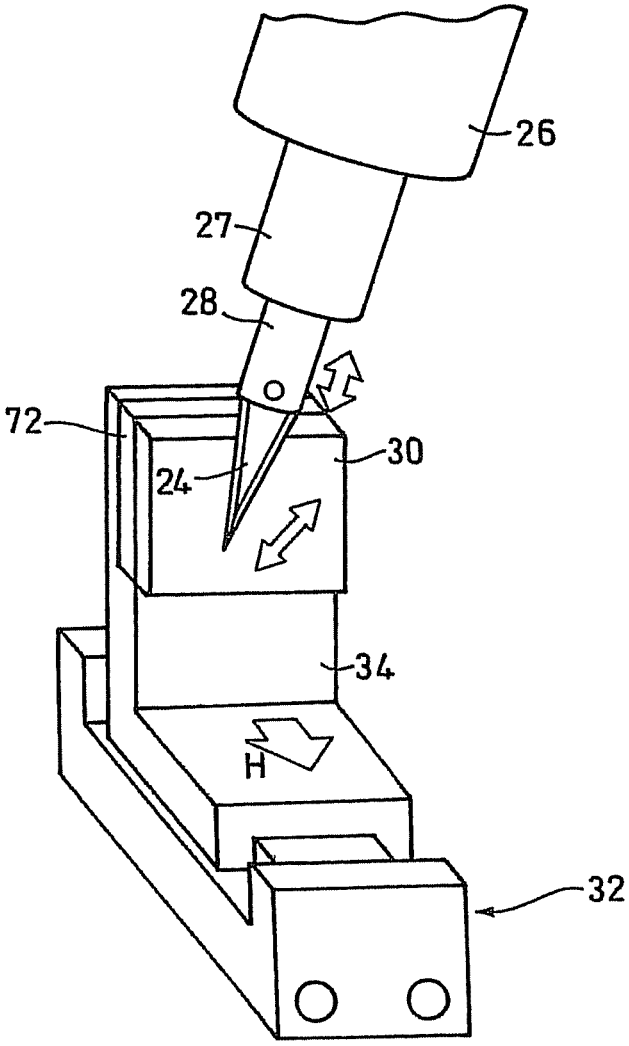
FIG. 12 is a perspective view schematically illustrating yet another embodiment of the grinding member.

In FIG. 12, the grindstone 30 is supported by an ultrasonic vibration apparatus 72 for ultrasonically vibrating the grindstone 30.

Even in this embodiment, preferably, the combined vibration direction of the direction of the ultrasonic vibration of the grindstone 30 and the direction of the ultrasonic vibration of the cutter blade 24 is set so as to be orthogonal to the cutting edge of the cutter blade.

Furthermore, in the above embodiment, the cutter blade 24 is ground in the ultrasonic trimming apparatus during trimming operation. However, at the timing of the grinding of the cutter blade 24, this blade may be replaced with a spare cutter blade which is ground and prepared in advance to thereby reduce the interruption time of the trimming operation by the amount of (the grinding time−the replacing time). In this case, the grinding of the cutter blade 24 is performed outside the movable range of the articulated robot independently of the trimming operation. The abovementioned replacement of the cutter blade is made also when the cutting blade is worn away until the grinding is no longer possible. Alternatively, the replacement of the cutter blade 24 is made only when the grinding is no longer possible.

Figure 13:
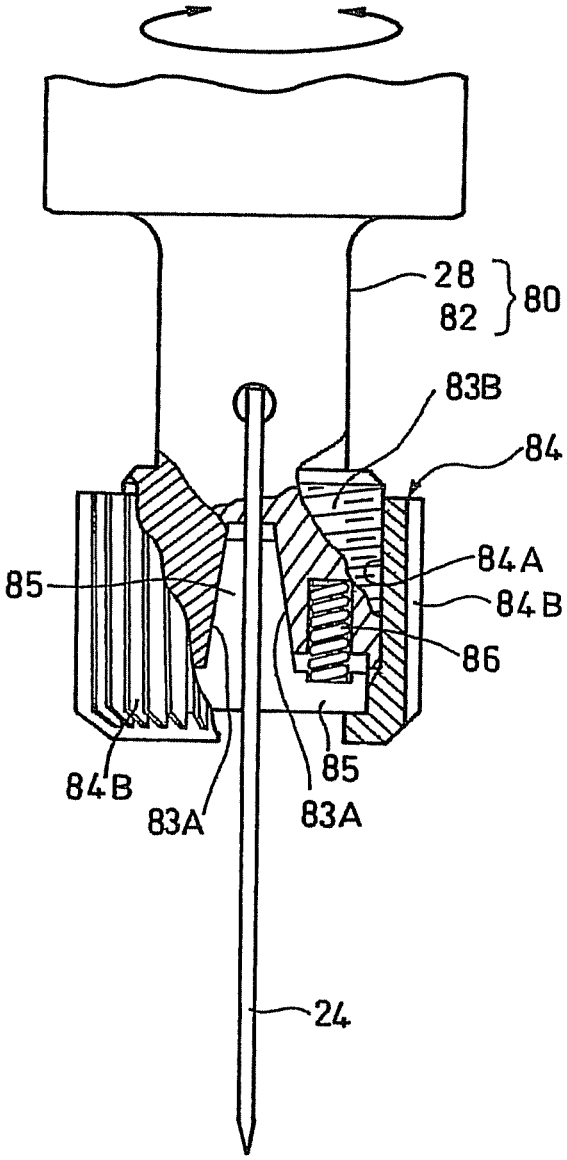
FIG. 13 is a cross-sectional view illustrating a main portion of an apparatus for automatically replacing a cutter blade in the ultrasonic trimming apparatus.
Figure 14:
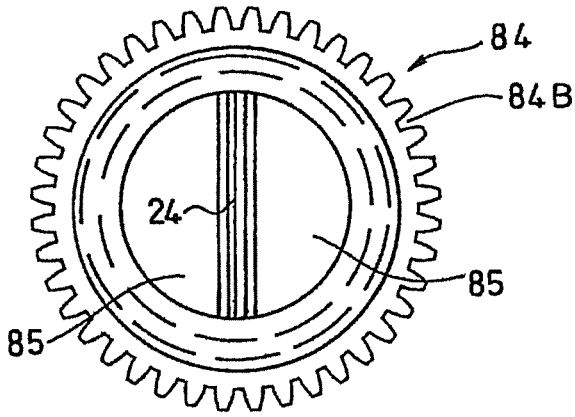
FIG. 14 is a plan view of FIG. 13.
Figure 15:
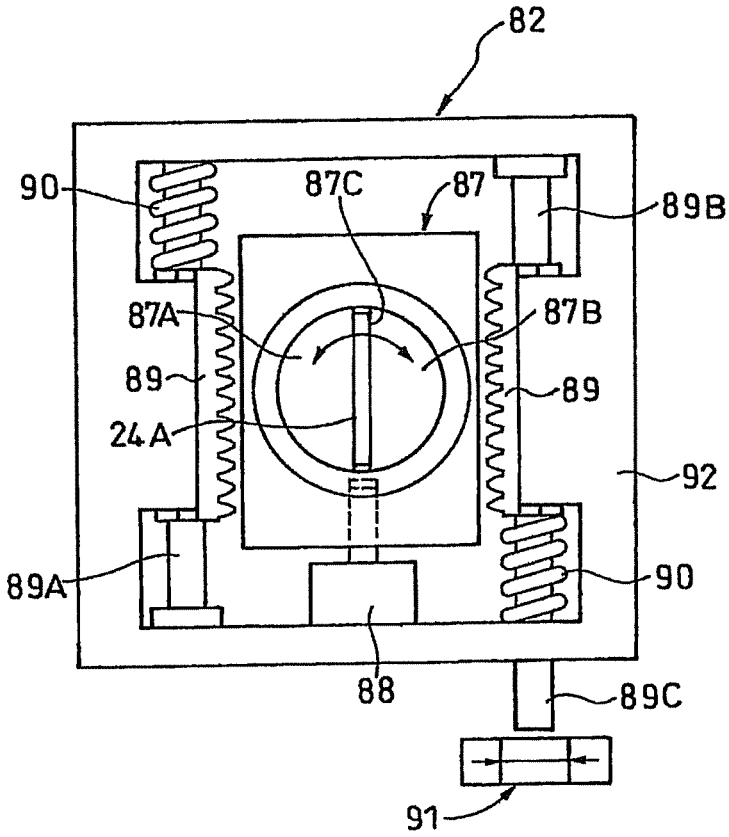
FIG. 15 is a plan view illustrating a holder for a spare cutter blade in the cutter blade automatically replacing mechanism.

The automatic replacement described above is made by means of a cutter blade automatic replacing apparatus 80 shown in FIGS. 13 to 15.

In the cutter blade automatic replacing apparatus 80, a cutter blade removing-attaching mechanism is provided in the abovementioned supporting horn 28, and the cutter blade 24 is made attachable to and removable from the supporting horn 28 through the rotation of the additional arm 18. Furthermore, a spare cutter blade 24A ground in advance is kept in advance in a spare cutter blade holder 82 shown in FIG. 15. When the cutter blade 24 is worn away through the trimming operation, the worn cutter blade 24 is dropped into a blank spare cutter blade holder 82, and the spare cutter blade 24A is attached to the supporting horn 28.

A detailed description is given of the abovementioned cutter blade automatic replacing apparatus 80.

A portion of the cutter blade automatic replacing apparatus 80 on the articulated robot 12 side is composed of the supporting horn 28 which is configured to detachably support the cutter blade 24; and the spare cutter blade holder 82 which is disposed within the movable range of the cutter blade 24 driven by the articulated robot 12. The abovementioned supporting horn 28 has tapered surfaces 82A which are opposing two surfaces inside the end portion thereof. Also, the supporting horn 28 is provided with a male screw 83B having an outer periphery onto which a female screw 84A can be screwed. The female screw 84A is formed on the inner periphery of a clamping ring 84, and an outer peripheral gear 84B is formed on the outer periphery of the clamping ring 84.

A pair of cutter blade sandwiching members 85, which have the same wedge-like shape and intervene between the abovementioned pair of the tapered surfaces 82A, is provided between a pair of the tapered surfaces 82A. Also provided therebetween is a pressing spring 86 which urges the pair of the cutter blade sandwiching members 85 in a downward direction in FIG. 13 (a direction of the tip end).

The supporting horn 28 is configured as follows. When the base end of the cutter blade 24 having a flat plate shape is inserted between the abovementioned pair of the cutter blade sandwiching members 85 and the female screw 84A is screwed onto the male screw 83B, the pair of the tapered surfaces 83A press the cutter blade sandwiching members 85. Then, the cutter blade sandwiching members 85 tightly sandwich the base end of the cutter blade 24 to clamp and fix the base end.

When the cutter blade 24 is removed, the clamping ring 84 is rotated in a direction in which the clamping ring 84 is loosened from the male screw 83B, whereby the clamping by the pair of the cutter blade sandwiching members 85 is loosened. Hence, the cutter blade 24 is allowed to be pressed downward by the pressing spring 86, and thus is allowed to be drawn downward by its self-weight.

As shown in FIG. 15, the spare cutter blade holder 82 has a casing 92 configured to contain a cutter blade holding portion 87, a rotation stopper 88, racks 89, compression springs 90, and a sensor mechanism 91.

The cutter blade holding portion 87 is provided with a pair of sandwiching members 87A and 87B. The spare cutter blade 24A is clamped and releasably held in a cutter blade accommodating groove 87C between the sandwiching members 87A and 87B. Here, in the cutter blade holding portion 87, the width of the cutter blade accommodating groove 87C between the abovementioned sandwiching members 87A and 87B can be arbitrarily adjusted by a driving mechanism (not shown), and the position of the cutter blade accommodating groove 87C can be adjusted in the rotation direction.

As shown in FIG. 15, the abovementioned rotation stopper 88 is configured to be capable of locking the sandwiching members 87A and 87B in the rotation direction only when the position of the cutter blade accommodating groove 87C is the same as a position for replacing the cutter blade.

In FIG. 15, the abovementioned racks 89 are symmetrically disposed in positions in which the cutter member holding portion 87 is interposed therebetween. However, in the axis line direction, each of the racks 89 is disposed in a position wherein the rack 89 is displaced from the cutter blade holding portion 87 toward the clamping ring 84 side in FIG. 13 in the direction of the central axis line of the cutter blade 24 or the supporting horn 28.

The amount of the displacement is set such that, when the cutter blade 24 enters the cutter blade accommodating groove 87C, the racks 89 can be engaged with the outer peripheral gear 84A formed on the outer periphery of the clamping ring 84.

The abovementioned pair of the racks 89 is slidably supported by a pair of guiding rods 89A and 89B provided in parallel with the pair of racks 89, and the guiding rod 89A is axially fixed inside the abovementioned casing 92.

Between the racks 89 and the casing 92 attached is a pair of the abovementioned compression springs 90 which, when the racks 89 are engaged with the abovementioned outer peripheral gear 84B, urges the racks 89 in a direction in which the engagement is loosened. Furthermore, an end 89C of the guide rod 89B is projected outside from the casing 92, the end 89C being on a side to which the compression spring 90 is attached. Furthermore, the end 89C is brought close to or is separated from the sensor mechanism 91 along with the guide rod 89B.

The sensor mechanism 91 is composed of for example, a proximity switch or a dropping-type beam sensor and is designed to detect the end of the guiding rod 89B when the end approaches the sensor mechanism 91 by a certain distance or more or enters a detection region.

When the cutter blade is automatically replaced, the cutter blade 24 is brought close to an empty holder from above by means of the robot 12, the blank holder being similar to the spare cutter blade holder 82 not holding a spare cutter blade. Then, the outer peripheral gear 84B is brought into engagement with the racks 89A and 89B, and the cutter blade 24 is inserted into the cutter blade accommodating groove 87C. In this state, the supporting horn 28 is rotated by the driving force of the robot 12 in a direction in which the male screw 83B is loosened from the female screw 84A. At this time, when the pair of the racks 89 engaged with the outer peripheral gear 84B is moved a predetermined distance in a direction in which the pair is separated from the compression springs 90, the pair of the racks 89 abuts on the inner wall of the casing 92 and is stopped. Therefore, the outer peripheral gear 84B is no longer rotated.

When the female screw 84B is loosened from the male screw 83B, the distance between the cutter blade sandwiching members 85 becomes large. Furthermore, the cutter blade sandwiching members 85 are pressed downwardly by the pressing spring 86, and thereby the sandwiched cutter blade 24 is dropped in the empty cutter blade accommodating groove 87C.

Next, the outer peripheral gear 84A is drawn upwardly from the racks 89 and is brought, from above, close to the spare cutter blade holder 82 in which the spare cutter blade 24A is held. Furthermore, the groove between the cutter blade sandwiching members 85 and the spare cutter blade 24A held by the spare cutter blade holder 82 are arranged such that the groove is aligned over the flat plane of the spare cutter blade 24A.

In this manner, the outer peripheral gear 84A enters between the racks 89 and thus can be engaged with the racks 89. At this time, the base end side of the spare cutter blade 24A enters the groove between the pair of the cutter blade sandwiching members 85.

In this state, the robot 12 is driven to rotate the supporting horn 28 such that the female screw 84A clamps the male screw 83B. Then, since the outer peripheral gear 84B is brought into engagement with the racks 89 and thus cannot rotate, the cutter blade sandwiching members 85 are rotated relatively.

Here, the lock by the abovementioned rotation stopper 88 is released, and thus the sandwiching members 87A and 87B are allowed to be rotated with the spare cutter blade 24A. Furthermore, the distance between the pair of the sandwiching members 87A and 87B is made large so that the spare cutter blade 24A is allowed to be drawn out.

The outer peripheral gear 84B and the female screw 84A rotate relative to the male screw 83B, whereby the cutter blade sandwiching members 85 tightly sandwich and fix the spare cutter blade 24A.

The limit of the clamping torque at this time is set to the value of the torque when the outer peripheral gear 84B drives the racks 89 against the spring force of the compression springs 90 and then the end of the guiding rod 89B is detected by the sensor mechanism 91.

By fastening the cutter blade sandwiching members 85 sufficiently with the female screw 84A, the spare cutter blade 24A is sandwiched and tightly secured between the pair of the cutter blade sandwiching members 85.

While being rotated, the female screw 84A presses the cutter blade sandwiching members 85 in an upward direction in FIG. 13 against the spring force of the pressing spring 86. Therefore, the cutter blade sandwiching members 85 is wedged between the tapered surfaces 83A to clamp and secure the spare cutter blade 24A.

As described above, in the spare cutter blade automatic replacing apparatus in this embodiment, the cutter blade 24 is removable from and attachable to the supporting horn 28, but the present invention is not limited thereto. The cutter blade automatic replacing apparatus may have other configuration.

Figure 16:
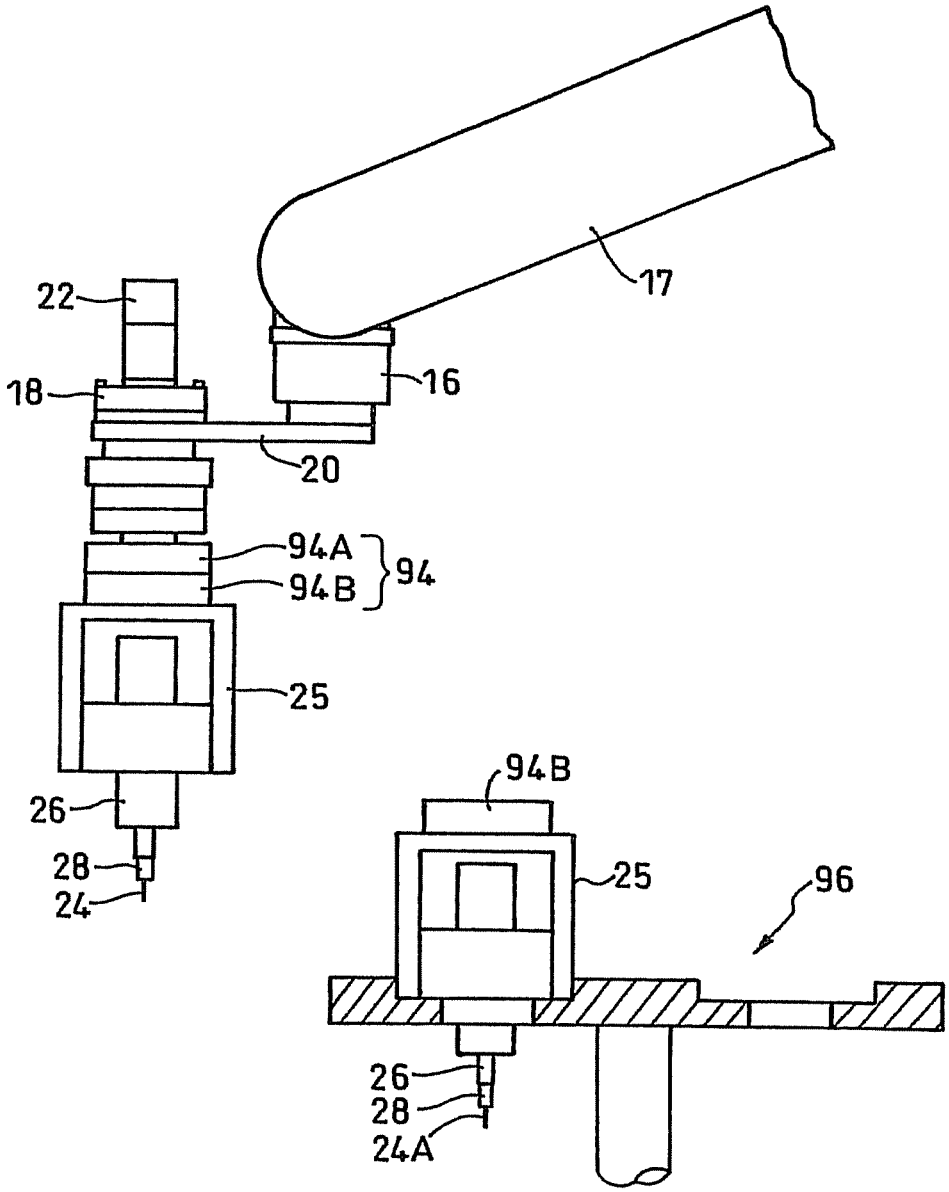
FIG. 16 is a front view illustrating a main portion of another embodiment of the apparatus for automatically replacing a cutter blade.

For example, as in an embodiment shown in FIG. 16, a commercial automatic tool changer 94 may be employed.

In this case, an automatic tool exchanger (Exchange XC series, product of NITTA CORPORATION) is employed as the automatic tool changer 94.

This automatic tool changer 94 is provided between an oscillator 95 and the additional arm 18, and the cutter blade 24 is removed from or attached to the additional arm 18 together with the oscillator 95.

In particular, the automatic tool changer 94 is composed of a robot adaptor 94A and a tool adaptor 94B which is removable from and attachable to the robot adaptor 94A through air. To the tool adapter 94B attached are the abovementioned oscillator 26, the vibrator 27, the supporting horn 28, and also the cutter blade 24.

In this embodiment, the tool adaptor 94B, the oscillator 95, . . . , and the cutter blade 24 are assembled in advance and is prepared in a spare tool storage space 96. At the time of replacement, the set of the tool adaptor 94B, the ultrasonic oscillator 95, . . . , and the cutter blade 24 is removed from the robot 12 and is placed in an empty space in the spare tool storage space 96, and the spare set placed adjacent to the removed set is attached to the robot by means of the automatic tool changer 94 to complete the replacement of the cutter blade.

The present invention is not limited to the abovementioned embodiments, and various modifications can be made in accordance with need. For example, the invention is applicable to the case in which an articulated robot having five or less joints is employed.

INDUSTRIAL APPLICABILITY

The ultrasonic trimming method of the present invention is provided with a grinding member disposed within the movable range of a cutter blade and capable of being brought into pressure contact with the cutter blade. The cutter blade is moved by means of a robot so as to contact the grinding member, and than an ultrasonic oscillator is driven to ultrasonically vibrate the cutter blade, whereby the cutter blade can be efficiently ground. Therefore, the efficiency of trimming of an interior sheet for an automobile or the like, a sheet for a chair, fabric in apparel industry can be improved.

The invention claimed is:

1. An ultrasonic trimming method, comprising:

driving a cutter blade having a flat plate shape and supported by an arm at an end of an articulated robot via an ultrasonic oscillator, the cutter blade being driven by the arm while the cutter blade is ultrasonically vibrated;

cutting a workpiece secured by a workpiece securing portion; and during, operation for cutting, moving the cutter blade held attached to the articulated robot to the position at where a cutting edge is brought into contact with a grinding member comprising a grindstone, maintaining the cutter blade's attitude such that a plane containing the cutting edge thereof contacts the grindstone, and grinding the cutter blade by pressing the cutter blade against a the grindstone member by the arm while the cutter blade is ultrasonically vibrated, the grinding member being disposed within a movable range of the cutter blade driven by the articulated robot.

2. The ultrasonic trimming method according to claim 1, wherein when the cutter blade is ground, the grinding member is urged toward the cutter blade by a fluid pressure cylinder.

3. The ultrasonic trimming method according to claim 1, wherein an additional arm rotatably connected to the arm at the end of the articulated robot supports the ultrasonic oscillator and the cutter blade and controls the cutter blade such that the cutter blade is always directed in a cutting direction.

* * * * *